United States Patent [19]

Skidmore

[11] 3,933,210

[45] Jan. 20, 1976

[54] DRILL HEAD ASSEMBLY

[76] Inventor: Sam C. Skidmore, 1513 Azteca Drive, Fort Worth, Tex. 76112

[22] Filed: Oct. 11, 1974

[21] Appl. No.: 514,252

[52] U.S. Cl. ..... 173/132; 173/80; 285/333; 403/343

[51] Int. Cl.[2] ..... E21C 15/02

[58] Field of Search ..... 173/80, 132, 105; 285/333, 285/334; 175/320, 415; 403/343

[56] References Cited

UNITED STATES PATENTS

| | | | |
|---|---|---|---|
| 1,326,643 | 12/1919 | Burns | 285/333 |
| 1,477,855 | 12/1923 | Thurston | 175/320 |
| 1,932,427 | 10/1933 | Stone | 403/343 X |

*Primary Examiner*—Ernest R. Purser
*Attorney, Agent, or Firm*—Charles W. McHugh

[57] ABSTRACT

A drilling tool assembly comprising an elongated shank having an upper end for receiving driving forces, and having tapered threads at its lower end for engaging a drill head. The shank has first and second downwardly facing shoulders, with one of said shoulders being above the threads and the other shoulder being below the threads. A removable drill head has tapered threads for engaging corresponding shank threads along substantially the full length thereof. The drill head also has first and second upperwardly facing shoulders adapted to respectively bear against the first and second shoulders on the shank. The drill head shoulders are positioned such that they are still separated from the confronting shank shoulders by a gap when the threads of the two elements initially make up along the pitch line during their assembly. The gap optimally falls within the range of about 0.010–0.070 inch, whereby the threads will be slightly deformed as torque is applied to the drill head in order to bring the confronting shoulders into load-bearing contact with one another. The preferred threads are modified American Standard Acme screw threads having a pitch of about 0.5.

5 Claims, 5 Drawing Figures

DRILL HEAD ASSEMBLY

This invention relates generally to earth boring bits, and more particularly to bits in which a drill head having a wear surface thereon can be removed from a shank and replaced with a fresh drill head after the first head has experienced significant wear, there being a threaded connection between the shank and the drill head.

In recent years, there have been attempts to develop efficient drill bits which are capable of both rotary action and percussion action in drilling holes into the earth. Exemplary of this type of combination drill bit is that shown in U.S. Pat. No. 3,185,228 to Kelly. The Kelly bit is shown as having a solid body including an upper portion (typically called the anvil) which receives both percussion and rotational loads, and a lower portion (usually called the head) in which are typically mounted hardened inserts for cutting through relatively hard earth formations. It can be readily seen that a unitary drill bit as shown in FIG. 1 of the Kelly patent could be made very sturdy, but it would have to be discarded—in its entirity—after the head had worn to the extent that it was no longer usable or repairable. Thus, a substantial quantity of special-purpose, hardened (and expensive) steel would have to be discarded after only part of it had suffered wear.

In an attempt to obviate at lest some of the economic loss that attended the discarding of unitary bits, the U.S. Pat. No. 3,791,463 to Pearson suggested that there could be a separate anvil piece and a head piece, with a threaded connection between the two. With the Pearson construction, at least it was possible to remove a head and discard it after it had suffered significant wear, while retaining the upper or anvil portion to which a new head could be threadably affixed. While it is believed that the concept of a replaceable head as taught by Pearson has great merit, it is believed that the deformable washers which constitute an essential part of his connecting means would prevent his bit from ever having the endurance that characterizes the unitary bit shown by Kelly. Accordingly, it is an object of this invention to provide a drill head assembly which has the economic advantages of a removable head as taught by Pearson and the rigidity which is inherent in a unitary bit exemplified by Kelly.

Other objects and advantages will no doubt be apparent from a reading of the specification and claims, and from a study of the drawings, in which:

Figure 1:
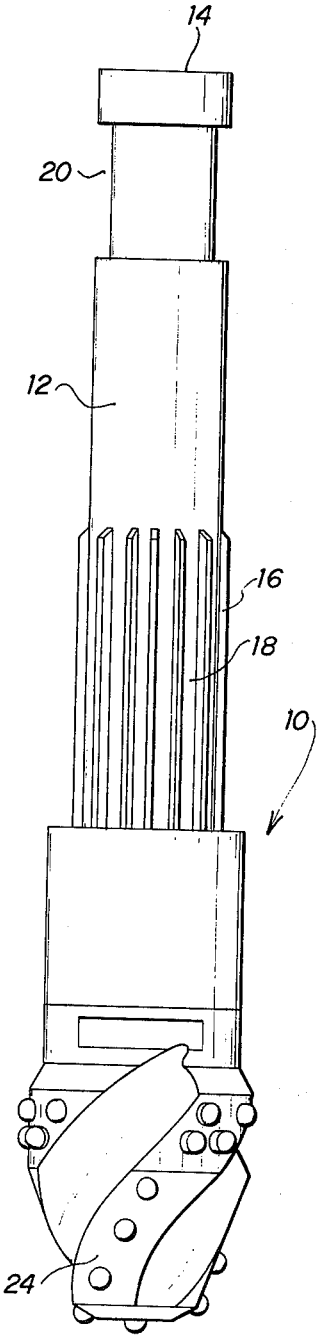
FIG. 1 is a side elevational view of an assembly according to the invention.

With initial reference to FIG. 1, a drill head assembly 10 includes a shank 12 and a removable drill head 24. The assembly is oriented (with one end being above the other) in the same way it would be oriented in drilling a vertical hole into the earth—with the upper end being toward the top of the page. The shank 12 has an upper portion with a horizontal end surface 14 which serves as an anvil for receiving axial forces provided by a percussion device (not shown). A portion of the outer surface of the shank 12 is machined to provide splines 16 and intermediate grooves 18 which are parallel to the longitudinal axis of the shank. It will be understood that these splines and grooves engage matching elements in the lower end of a percussion tool, and are used to transmit rotational forces to the assembly 10. A circumferiential groove 20 is provided below the upper end of the shank so as to form an annular space between the body of the shank and a percussion tool. A split ring (not shown) is inserted into this annular space so as to retain the shank on the percussion tool. Also provided on the shank, but not shown in this figure, are tapered threads for engaging (and forming a rigid connection with) the drill head 24.

Figure 2:
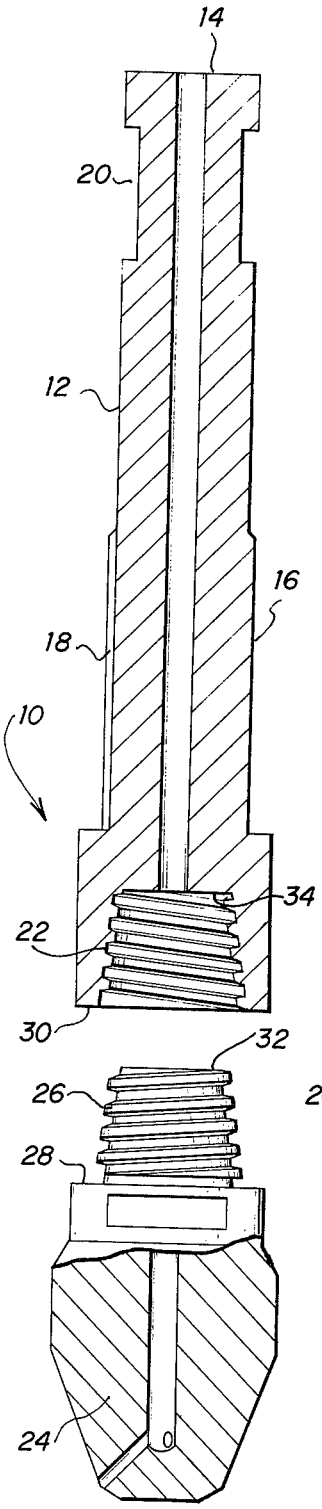
FIG. 2 is a partially sectioned side elevational view of the two parts of the assembly shown separated by a small distance.

Referring next to FIG. 2, a preferred embodiment of the shank 12 is shown in cross-section, to clearly illustrate the tapered threads 22—which are internal (or female) threads. The removable head 24, shown slightly spaced from the shank 12 (where it would be located just prior to engagement) has matching external threads 26 which are tapered by the same amount as the threads 22. These tapered threads constitute a critical facet of the construction described herein, for the reason that it is intended that all of the threads should "make up", along the pitch line, simultaneously as the two elements 12, 24 are rotatably engaged. That is, the uppermost thread *a* on the drill head 24 will positively engage its mating thread *a'* on the "box" at the same time that the lowermost thread *b* on the "pin" mates with its confronting thread *b'*. Of course, the intermediate threads on the two elements 12, 24 also abut one another at the time that the two extreme threads make contact, so the threads may be properly described as being uniformly engaged along the full length thereof.

With continuing reference to FIG. 2, a radially outer shoulder surface 28 is provided at a location on the removable head 24 such that it is beyond one end of the threads 26, i.e., below the threads. This shoulder 28 is provided to accommodate longitudinally applied impact loads, so it is preferably perpendicular to the longitudinal axis of the assembly 10. The lower shoulder 28 has a substantial surface area, in order that the sever dynamic loading which is characteristic of percussion-type bits will be tolerable. In further recognition of the loading which can be anticipated in drilling through hard formations, a preferred material for the head is 4340 steel which has been heat treated to a hardness within the range of about Rc 38–42. A suitable commerically available material is HY-TUF alloy steel manufactured and sold by the Crucible Alloy Division of Colt Industries in Midland, Pennsylvania.

The upwardly facing impact surface 28 is adapted to bear against radially outer shoulder surface 30 on shank 12 after the pieces 12, 24 have been assembled, as hereinafter described. Additionally, a radially inner shoulder surface 32 is provided on the removable head 24 such that it lies beyond (i.e., above) the other end of the tapered threads 26. The shank 12 has a matching inner surface 34 which faces downward and whose configuration is such as to bear against surface 32 when the pieces 12, 24 are suitably engaged. Assuming the surfaces 28 and 32 to be horizontal, the vertical distance between said two surfaces should be exactly the same as the vertical distance between corresponding surfaces 30 and 34 (on shank 12), such that the juxtaposed surfaces 28, 30 and 32, 34 will meet one another at the same time during assembly of the elements 12, 24.

A further requirement of the drill head assembly 10 is that the juxtaposed surfaces 28, 30 and 32, 34 must have a gap therebetween at the time that the threads 22, 26 make up during connection of the pieces 12, 24. That is, if head 24 is being screwed into shank 12, at some time the threads 26 will uniformly engage threads 22 along substantially their full length; assuming that the only torsional forces which are being applied to rotate head 24 are forces of a magnitude typically obtained with hand tightening, there will still be a gap visible between surfaces 28, 30 when the threads make up. A subsequent step in the proper assembly of the unit is to eliminate that gap by applying sufficient torque to the head 24 to deform the threads 26 and/or threads 22. However, there is a limit to the amount of thread deformation that can be safely accommodated before one or more threads might fail as a result of shearing. It has been found that the gap which exists at the time of initial thread make up should be at least 0.010 inch and preferably no more than 0.070 inch. If the initial gap is too low, i.e., less than 0.010 inch, it has been found that the torqued joint will not be sufficiently rigid during the application of percussive loads during drilling through hard formations. The consequence of this is that the threads will eventually break because of bending loads that obtain when there is any flexure permitted between the head 24 and the shank 12. At the other extreme, i.e., when the gap exceeds about 0.070 inch, the threads 26, 22 are subjected to too much deformation in order to achieve load-bearing contact between the juxtaposed surfaces 28, 30 and 32, 34. As should be apparent, it is exactly such load-bearing contact that gives the assembly 10 its characteristic rigidity, such that it is essentially as sturdy as a unitary bit like the one shown in the aforementioned patent to Kelly.

Figure 3:
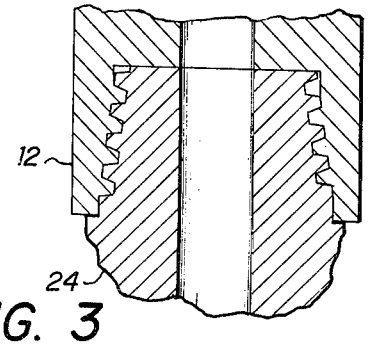
FIG. 3 is a cross-sectioned view of a suitable threaded connection for joining the two parts of the assembly.

Referring next fo FIG. 3, the preferred threads 22, 26 for effectively locking the head to the shank are modified Acme screw threads. Of course, Acme screw threads are quite old, and they have been used as an alternate to conventional square threads in power transmission applications for many years. That is, conventional (straight) Acme screw threads are routinely used to produce transverse motion on machines such as lathes; they are also typically used on vises, jacks, etc. The American Standard Acme screw thread has an included angle of 29°, a tooth crest of 0.37P (where P is the pitch), and a tooth depth of one-half of the pitch. In this invention, it is preferred that the tooth depth be less than standard, in order to strengthen the threads (for one reason); accordingly, it is modified to be equivalent to the American Standard Stub Acme thread. The preferred pitch is 0.5, i.e., there are two threads per inch. In practice, suitable threads can be machined by using a 1¾ Standard Acme thread guage while actually maintaining two threads per inch; this has the effect of making the crest of each tooth slightly wider than standard teeth, and the depth will be correspondingly reduced.

One further parameter which can have an effect on the rigidity of the joint between the pieces 12, 24 is the spatial relationship between the crest of one thread and the root of a confronting thread, as compared with the spatial relationship of the adjacent sides. It has been found to be advantageous for the sides (or flanks) of the threads to be in firm, load-bearing contact with one another after the joint has been torqued; and, if there should perhaps be insufficient clearance between the root and crest of juxtaposed threads, this favored contact along the sides might not be achieved. It is preferred, therefore, that any clearance that might possibly exist between fully torqued threads should exist between the respective roots and crests—and not between the adjacent sides. Any such clearance—if it exists—will, of course, be minute, since it is an object of the invention to achieve a substantially solid connection between the pieces 12, 24 whereby flexure between the two is precluded.

The preferred taper of the threads 22, 26 is 1½ inch per foot. For comparison, it may be profitable to note that this is exactly twice the amount of taper called for by the American Standard (Briggs) taper pipe thread specification. As a further comparison, the specification established by the American Petroleum Institute for Rotary Drilling Equipment calls for rotary shouldered connections having tapers of 2 and 3 inches per foot where the large diameter of a "pin" lies in the range of about 2 to about 7 inches.

One further parameter of the threads 22, 26 will now be discussed, and that is the surface finish thereof. The amount of torque required to squeeze the threads together (until the shoulders are brought into firm metal-to-metal contact) will be a function of both the initial gap between the shoulders and the surface finish of the threads. As a practical matter, it is advantageous that the torque requirement be kept within a range of values that are commonly employed in the field to set joints on drill pipe. Such values for tool joint connections range from about 4000 Lb-Ft for 3½ inch connections to about 25,000 Lb-Ft for 5½ inch connections. Of course, striving to keep the torque requirements at a relatively modest level is normally conducive to greater endurance for the threads, since less thread distortion is required before the impact shoulders 28, 30 close the gap and bear against one another. It should also be appreciated, however, that rough machined threads can contribute to greater relative movement between two parts—in response to a given amount of torque applied to those parts—than would smooth and polished threads. This is because rough threads typically have high spots on their surfaces that are flattened or bent during the initial phase of thread engagement. Hence, two pieces with a rough surface finish on their threads may advance linearly with respect to one another by a significant distance before the really solid portions of the two pieces come into rigid contact. If these high (and low) spots are first removed by grinding, polishing and the like—such that the surface finish is much smoother, then engagement will bring the two pieces into solid contact much sooner. Hence, an attempt to close too much of a gap by applying very large torsional forces to smooth pieces can cause the threads to be sheared from the base metal . . . either at the very time the pieces are being threaded together or soon thereafter when repeated percussive loads have had their deleterious effect on the threads. Accordingly, with threaded connections of the type being discussed herein, the smoothness of the threads should be taken into account when the size of the initial gap between confronting impact surfaces is being established (by the machining of the connecting parts). Indeed, it has been found that a fairly reliable guideline may be defined for use in establishing the amount of initial gap that should exist beteween confronting impact surfaces when the threads make up due to hand tightening. This guideline actually constitutes a range of values that are derived from establishing a ratio between the surface finish of the sides (flanks) of the threads and an optimum gap between the confronting surfaces. With the surface finish being measured in microinches and the initial gap being measured in thousandths of an inch, it has been established that the ratio should be between about 3.0 and 8.0. Of course, the surface finish of the roots and crests of the threads cannot be totally ignored while paying attention to only their sides, but it should be remembered that it is side contact rather than root-to-crest contact that is of primary interest herein—so as to insure that the threaded connection will be long lasting and successful.

In operation of the invention, a shank 12 and a matching drill head 24 would be put into proper relative position with respect to each other and then rotated to initiate thread engagement. Of course, when the first tapered threads initially engage one another, there will still be considerable transverse motion possible—because of the inherent nature of tapered threads. That is, the initial engagement of the parts 12, 24 will be no problem, because there will still be plenty of clearance between the confronting roots and crests of the first threads to interlock. The ease with which engagement is accomplished with tapered threads should perhaps be mentally contrasted with what happens when straight threads are connected. If straight threads are fabricated with what amounts to an interference fit (in order to preclude flexure in the joint when it is in use), then there is no practical way to break or make the connection in the field. Too, the galling of threads is always a potential problem when engaging close fitting straight threads. On the other hand, if sufficient clearance is provided to make assembly of the parts more practicable, then there is not enough rigidity in the joint to preclude failure due to flexure in the threads. (Inserting a washer of cold rolled steel would be of no benefit in taking up the slack in a loose joint, since cold rolled steel is relatively soft and it would yield—like a cushion—so that flexure and eventual thread failure would still be the result.)

Figure 4A:
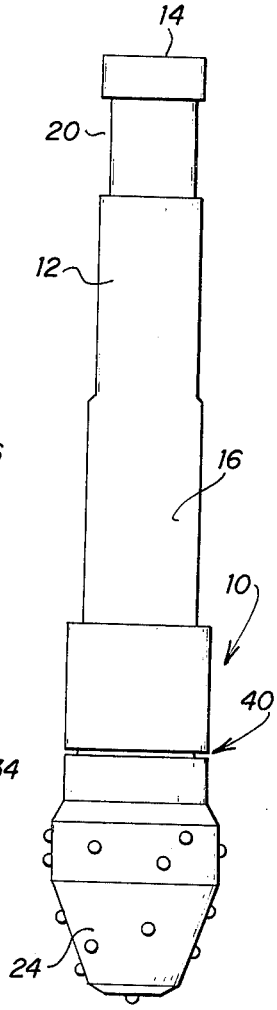
FIG. 4A is a side elevational view of the assembly with the joint made up hand tight, showing that there is still a gap between the confronting impact surfaces.
Figure 4B:
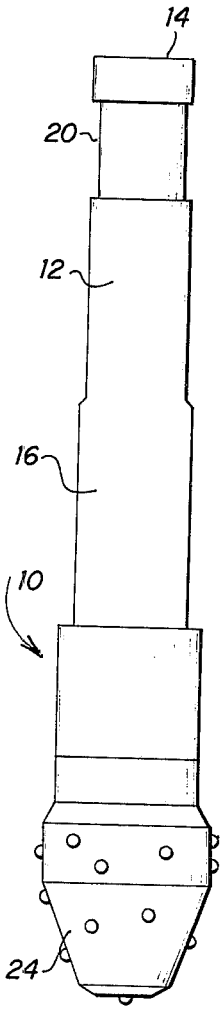
FIG. 4B is a view similar to FIG. 4A after the joint has been torqued to the extent that the impact surfaces are in load-bearing contact with each other.

Upon further relative rotation of the two elements 12, 24 (by hand, if desired), the threads 22, 26 will eventually make up along the pitch line, such that there will be uniform contact at the pitch line between all of the threads. An examination of the outside of the assembly 10 (as seen in FIG. 4A) will reveal that there is still a gap 40 visible between the exterior impact surfaces 28, 30. Of course, there will also be an identical gap between the interior surfaces 32 and 34—because the distance between the surfaces 28 and 32 (on the head 24) is the same as the distance between the surfaces 30 and 34 (on the shank 12). Hence, continued rotation of the head 24 with respect to the shank 12 (with a powered torque wrench or the like) will cause the impact surfaces 28, 30 to engage simultaneously with impact surfaces 32, 34. Assuming that the thread flanks had a typical surface finish of 125 RMS microinches, the gap 40 which would be eliminated by forces generated with the torque wrench would likely be about 0.025 inch. (Of course, the gap 40 is slightly exaggerated in the drawing, for clarity.) According to the previously defined rule, the ratio of surface finish to stand-off distance would be $125/25 = 5$, which is within the optimum range of 3 to 8. After the gap 40 has been reduced to zero, the respective confronting shoulders 28, 30 and 32, 34 will preclude any significant further compression or distortion of the threads 22, 26—even under loads which are typical of percussion hammers. The tapered threads 22, 26 will be in compressed metal-to-metal contact all along their flanks, and such clearance as might exist anywhere in the joint would be the minute (and uniform) clearance between the confronting roots and crests of the threads.

During drilling operations wherein a percussion hammer is used for driving a tool assembly 10 into the earth, the juxtaposed shoulders above and below the threads are effective to accommodate axially applied loads, such that the threads are effectively insulated from forces that would otherwise tend to tighten them until they failed.

After the initial drill head 24 has been used for some time, it may well suffer sufficient wear so that a prudent operator feels that it is time to replace the drill head. Typically, the tool assembly 10 is brought up to the earth's surface, and a single wrench is engaged with the drill head in a slot provided for such a purpose. Since most drill stem joints have fine threads with at least four (and typically five or six) threads per inch, and since fine threads tend to tighten more than coarse threads in response to a given torque, the connection between the drill head 24 and its shank 12 (with its relatively coarse two threads per inch) will normally break open well before any of the joints on the drill stem. Once the connection between the drill head and the shank has been broken loose, there is no immediate risk of the drill head immediately falling off—because the several threads (typically four, although more may be provided) will still provide a certain amount of loose engagement between the two pieces. Hence, the drill head may be leisurely unscrewed from the shank without risk of losing control over it. Once the drill head has fallen free from the vertical shank, a fresh drill head 24 can be immediately inserted and affixed to the shank as herein-above described. As a practical matter, it would probably be expected that an operator would purchase one shank and five or six matching drill heads at one time. The extra drill heads on hand should insure that a fresh head would be readily available when needed, and one shank could easily be expected to outlast several drill heads—even when the threaded connection described herein is being applied to percussive bits (rather than rotary or drag bits).

It should be noted, perhaps, that the tapered threads are illustrated herein as being external or male threads on the drill head, and internal or female threads on the shank. One reason for this arrangement is that the relatively pointed drill head will typically have internal flow passages for accommodating a cooling medium and it will also have numerous small surface cavities for accommodating hardened inserts; if these were to be combined with a large bore for providing the needed tapered threads, there might not be sufficient metal left in the drill head to give it the rigidity and strength that is desirable. Of course, if the cooling channels and the cavities for metal carbide inserts could be omitted as being unnecessary for a particular drill bit, then reversing the arrangement on the tapered threads might not be too significant.

While only the preferred embodiment of the invention has been disclosed in great detail herein, it will be apparent to those skilled in the art that modifications thereof can be made without departing from the spirit of the invention. Thus, the specific structure shown herein is intended to be exemplary and is not meant to be limiting, except as described in the claims appended hereto.

What is claimed is:

1. A drilling tool assembly, comprising:

a. a shank having an upper end for receiving driving forces which are intended to drive the assembly into the earth, and having a counterbore opening at its lower end with internal tapered threads for engaging a drill head, and the shank having first and second downwardly facing impact surfaces, with one of said impact surfaces being above the threads and the other impact surface being below the threads;

b. a removable drill head having an upward protuberance with external tapered threads for engaging corresponding shank threads along substantially the full length thereof, and the drill head having first and second upwardly facing impact surfaces adapted to respectively bear against the first and second impact surfaces on the shank, and the drill head impact surfaces being positioned such that they are still separated from the confronting shank impact surfaces by substantially identical gaps when the threads of the two elements initially make up along the pitch line, and the flanks of the threads having a certain surface finish measured in microinch units, and the ratio of surface finish (as measured in microinches) to the initial gap between confronting impact surfaces (as measured in thousandths of an inch) is between about 3.0 and 8.0, and said initial gaps between the impact surfaces being within the range of about 0.010–0.070 inch, such that the threads will be slightly deformed as torque is applied to the drill head in order to bring both sets of confronting impact surfaces into load-bearing contact with one another.

2. The drilling tool assembly as claimed in claim 1 wherein the threads are equivalent to American Standard Stub Acme screw threads having a pitch of about 0.5.

3. The drilling tool assembly as claimed in claim 1 wherein the tapered threads are designed to have minute clearances between their roots and crests even after the assembly has been torqued to the extent that the confronting impact surfaces are in load-bearing contact with one another.

4. A drilling tool assembly, comprising:

a. a shank having an anvil at its upper end for receiving percussive blows and having splines along its sides for receiving rotary forces, and having a counterbore at its lower end which is provided with tapered threads for engaging a drill head, and the shank having first and second downwardly facing shoulders, with one of said shoulders being above the threads and the other shoulder being below the threads;

b. a removable drill head having a frustoconical protuberance with external tapered threads for engaging corresponding threads on the shank, and the drill head having first and second upperwardly facing shoulders adapted to respectively bear against the first and second shoulders on the shank, and the drill head shoulders being positioned such that they are still separated from the respective shank shoulders by a gap when the threads of the two elements initially make up along the pitch line, and said gap being within the range of about 0.010–0.070 inch, whereby the threads will be slightly deformed as torque is applied to the drill head in order to bring the confronting shoulders into load-bearing contact with one another, and the distance between the two shoulders on the shank being identical to the distance between the two shoulders on the drill head, whereby the respective confronting shoulders will engage each other simultaneously as the drill head and shank are threadably engaged.

5. A drilling tool assembly as claimed in claim 4 wherein there are at least four full threads on the drill head, with said threads being modified American Standard Acme screw threads having a pitch of about 0.5, and having a surface finish on the sides thereof of about 125 RMS.

* * * * *